US006447347B1

(12) United States Patent
Steinhauser

(10) Patent No.: US 6,447,347 B1
(45) Date of Patent: Sep. 10, 2002

(54) TROLLING MOTOR POSITION RESPONSIVE SYSTEM

(76) Inventor: Louis P. Steinhauser, 2448 Cripple Creek Dr., St. Louis, MO (US) 63129

( * ) Notice: Subject to any disclaimer, the term of this patent is extended or adjusted under 35 U.S.C. 154(b) by 0 days.

(21) Appl. No.: 09/899,308

(22) Filed: Jul. 5, 2001

Related U.S. Application Data

(60) Provisional application No. 60/216,209, filed on Jul. 6, 2000.

(51) Int. Cl.[7] ..... B63H 21/22
(52) U.S. Cl. ..... 440/1; 6/85
(58) Field of Search ..... 440/1, 2, 6, 7, 440/84, 85

(56) References Cited

U.S. PATENT DOCUMENTS

| | | | | | |
|---|---|---|---|---|---|
| 3,641,965 | A | | 2/1972 | Schmiedel | |
| 3,834,345 | A | | 9/1974 | Hager et al. | |
| 3,894,250 | A | | 7/1975 | Hager et al. | |
| 4,005,674 | A | | 2/1977 | Davis | |
| 4,114,074 | A | * | 9/1978 | Stewart et al. | 318/257 |
| 4,205,300 | A | | 5/1980 | Ho et al. | |
| 4,278,854 | A | | 7/1981 | Krause | |
| 4,414,541 | A | | 11/1983 | Ho | |
| 4,459,115 | A | | 7/1984 | Ballard | |
| 4,536,755 | A | | 8/1985 | Holzgang et al. | |
| 4,565,010 | A | | 1/1986 | Herman | |
| 4,841,825 | A | | 6/1989 | Laut | |
| D316,528 | S | | 4/1991 | Wilson, Jr. | |
| 5,038,137 | A | | 8/1991 | Lloyd | |
| 5,041,030 | A | * | 8/1991 | Payne, Sr. | 440/2 |
| 5,129,845 | A | * | 7/1992 | Henderson | 440/1 |
| 5,459,447 | A | | 10/1995 | Snyder et al. | |
| 5,612,670 | A | | 3/1997 | Snyder et al. | |
| 5,760,696 | A | | 6/1998 | Sadri et al. | |
| 6,254,441 | B1 | * | 7/2001 | Knight et al. | 440/1 |
| 2002/0006753 | A1 | * | 1/2002 | Steinhauser | 440/1 |

* cited by examiner

*Primary Examiner*—Stephen Avila
(74) *Attorney, Agent, or Firm*—Harness, Dickey & Pierce, P.L.C.

(57) ABSTRACT

A trolling motor position responsive system is disclosed that warns and/or prevents a powerboat operator from engaging an outboard motor while the trolling motor remains deployed in the water. The system comprises a trolling motor position sensor that is in communication with an ignition switch, wherein the sensor activates an alarm and/or a ignition disabling switch when an operator attempts to engage the outboard motor when the trolling motor remains deployed in the water. An interval-on relay is also provided that limits the amount of time that the alarm and/or the ignition disabling switch are activated. The interval-on relay further prevents against wave-induced alarms with certain types of trolling motor position sensors in accordance with the present invention. A device is also provided that is easily retrofittable with the existing ignition system of a powerboat.

62 Claims, 5 Drawing Sheets

TROLLING MOTOR POSITION RESPONSIVE SYSTEM

CROSS-REFERENCE TO RELATED APPLICATIONS

This application is based upon Provisional Patent Application, Ser. No. 60/216,209, entitled "Power Boat Motor Alarm and/or Disabling Device," filed Jul. 6, 2000, the contents of which are incorporated herein by reference in their entirety and continued preservation of which is requested.

FIELD OF THE INVENTION

The present invention relates generally to powerboat motors and more particularly to alarms and ignition disabling systems for powerboats that are responsive to the relative position of a trolling motor.

BACKGROUND OF THE INVENTION

Systems that provide position sensing and response capability when a predetermined position or change in position of an object occurs have been disclosed for a variety of applications such as vehicle theft prevention, medical patient monitoring, earthquake detection, and to a limited extent, powerboat motors. Position sensing is generally accomplished in the related art with mercury switches, transducers and comparator circuits, variable resistance devices, infrared detectors, and other electrical devices. When a threshold position or condition has been registered by the position sensor, the sensor transmits a signal to a response device such as an alarm to warn an operator of an undesirable position of the object.

Relative position sensing is commonly accomplished in the related art with a mercury switch, wherein mercury flows to a pair of contacts to provide electrical continuity when a predetermined orientation or position of the object has occurred. For example, the mercury switches disclosed in U.S. Pat. No. 5,038,137 to Lloyd and U.S. Pat. No. 4,536,755 to Holzgang et al. sense the displacement of a patient relative to a reference and initiate an audible alarm when a certain threshold position is exceeded. Similarly, the mercury switch disclosed in U.S. Pat. No. 4,565,010 to Herman senses the gross horizontal and vertical position of a level, wherein, both an audible and a visible indication of position is generated.

An additional application of a mercury switch is disclosed in U.S. Pat. No. 4,205,300 to Ho et al. for automobile theft prevention. Ho employs a mercury switch to sense the general movement of a vehicle and to initiate an alarm. The device of Ho also communicates with the ignition system of the vehicle to cut off power when the alarm is activated. Unfortunately, the device of Ho does not sense the relative position of the vehicle and is not further activated by the ignition system. Additionally, the mercury switches of the related art are also prone to false alarms when the object or device is randomly displaced after a desired condition has been achieved.

The related art does not appear to provide a relative position sensing device or method to warn the operator and/or disable the ignition system of a powerboat when the trolling motor remains deployed in the water as the outboard motor is engaged. Often times, operators accidentally start the outboard motor and apply normal take-off throttle without first pulling the trolling motor out of the water. If the trolling motor is not properly stowed before engaging the outboard motor, severe damage to both the trolling motor and/or the powerboat structure could result from the forward thrust produced by the outboard motor. For example, the shaft of the trolling motor could be permanently bent or broken, and/or the trolling motor mounts to the powerboat structure could be damaged, thereby resulting in costly repairs and an abrupt ending to an otherwise enjoyable fishing experience.

Accordingly, there remains a need in the art for a device that can warn or prevent a powerboat operator from starting and engaging the outboard motor when the trolling motor remains deployed in the water. The device should also be inexpensive and capable of being affordably retrofitted into existing powerboat systems.

SUMMARY OF THE INVENTION

In one preferred form, the present invention provides a trolling motor position responsive system that warns or prevents a powerboat operator from engaging the outboard motor while the trolling motor remains deployed in the water. The position responsive system generally comprises a trolling motor position sensor that senses the relative position of the trolling motor and transmits a signal to activate an alarm and/or an ignition disabling switch when an operator attempts to start the outboard motor while the trolling motor remains deployed in the water. Accordingly, the alarm warns the operator that the trolling motor remains deployed in the water, and the ignition disabling switch prevents the operator from starting or engaging into motion the outboard motor. Either one or both the alarm or the ignition disabling switch may be employed according to the specific requirements of the operator.

The position responsive system further comprises an interval-on relay in communication with the trolling motor position sensor and the alarm and/or ignition disabling switch to limit the amount of time that the alarm and/or ignition disabling switch are activated. If the operator attempts to engage the outboard motor while the trolling motor remains deployed in the water, the alarm and/or ignition disabling switch are activated for a predetermined amount of time, for example, approximately five (5) seconds. After the predetermined amount of time, the operator may engage the outboard motor and proceed at their own risk.

Often times, an operator may desire to slowly maneuver the powerboat with the outboard motor rather than the trolling motor at a speed that will not result in any damage. Accordingly, the interval-on relay allows the alarm and/or the ignition disabling switch to be bypassed after a predetermined amount of time for such an operating condition. Additionally, the interval-on relay may be employed to prevent against wave-induced alarms or activation of the ignition disabling switch with certain types of trolling motor position sensors as described in greater detail below.

The trolling motor position sensor in one form is a mercury switch that is mounted to a shaft of the trolling motor. Since mercury within the mercury switch may randomly move about while the powerboat 10 is traversing through the water, intermittent electrical continuity may be created, thereby causing inadvertent activation of the alarm and/or the ignition disabling switch. Accordingly, the interval-on relay prevents against such wave-induced alarms.

Other devices may also be employed to sense the relative position of the trolling motor including, for example, a mechanical limit switch, a proximity switch, an optical switch, or a water sensing device. With the use of a water sensing device to sense the relative position of the trolling motor, the requirement of an interval-on relay may be eliminated because the water sensor may not produce false alarms due to waves since the water sensor would be completely out of the water when the trolling motor is properly stowed during normal cruising operations.

The alarm in one form is an audible electric buzzer that warns the operator when the trolling motor remains deployed in the water. Other alarms may also be employed in other forms of the present invention, for example, a light such as an LED (light emitting diode) mounted to the helm, or a computerized voice warning. In addition to disabling the ignition system with an ignition disabling switch, responsive systems that initiate automatic stowage of the trolling motor into a properly stowed position are also provided.

Communication amongst the trolling motor position sensor, the interval-on relay, the alarm, and the ignition disabling switch may be accomplished by conventional hard wiring, infrared (IR) signal transmission and reception, or radio frequency (RF) signal transmission and reception, among others. Further, signals may be superimposed over existing powerboat hard wiring to minimize the need for additional hard wire connections.

The present invention also provides a junction box that houses the components of the position responsive system, which is easily retrofittable with existing ignition systems of powerboats. The junction box is relatively small and further comprises an adjustment screw that corresponds with a potentiometer to adjust the amount of time that the alarm and/or ignition disabling switch remains activated as more fully described below.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
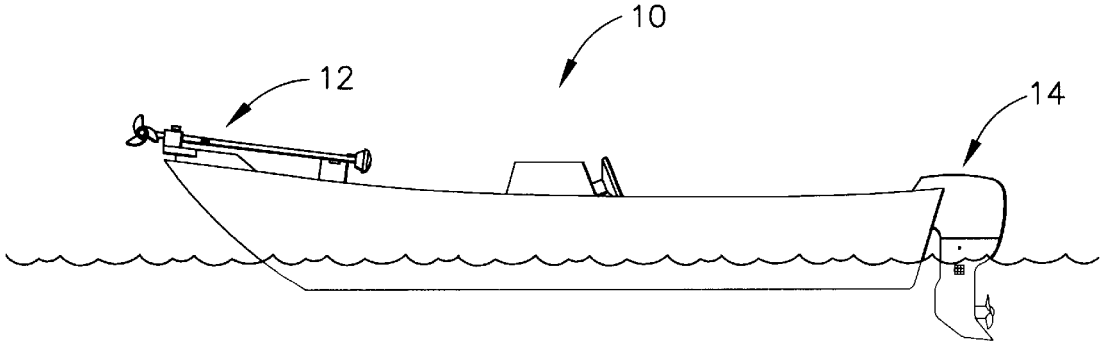
FIG. 1 is a side view of a powerboat in the water with a trolling motor in a properly stowed position in accordance with the present invention.
Figure 2:
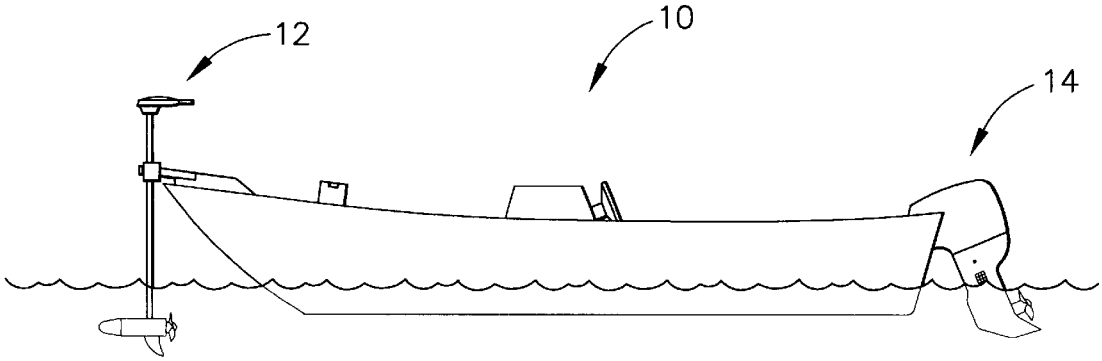
FIG. 2 is a side view of a powerboat in the water with a trolling motor in the deployed position and an outboard motor tilted up in accordance with the present invention.

Referring to FIGS. 1 and 2, a typical powerboat 10 used for fishing generally includes a trolling motor 12 and an outboard motor 14. When the powerboat 10 is being operated with a substantial amount of throttle, e.g., take-off, cruise, the trolling motor 12 is in a stowed position on the deck as illustrated in FIG. 1. When the powerboat 10 is being operated with little or no throttle while fishing, the trolling motor 12 is deployed in the water to quietly maneuver the powerboat 10 as illustrated in FIG. 2. Outboard motor 14 may either remain tilted down in the water as shown in FIG. 1 or tilted up out of the water as shown in FIG. 2 when trolling motor 12 is deployed into the water while fishing or trolling.

Figure 3:
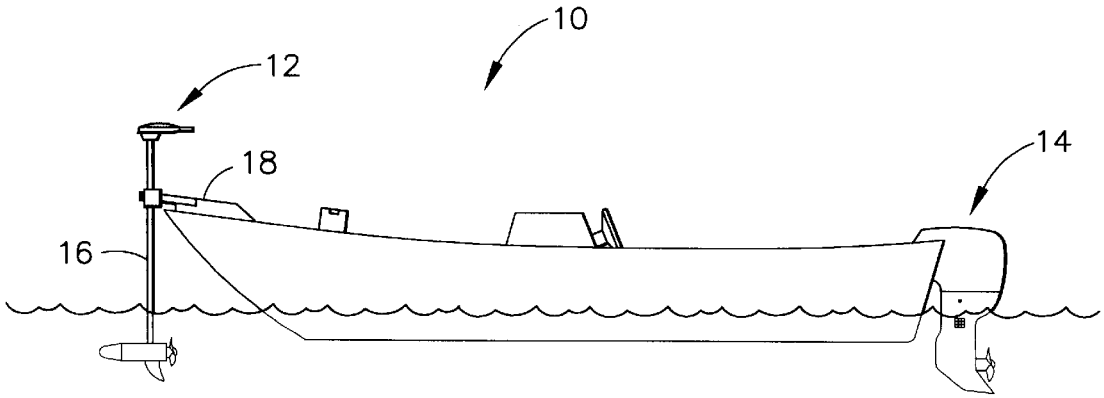
FIG. 3 is a side view of a powerboat in the water with a trolling motor in the deployed position and an outboard motor tilted down in accordance with the present invention.

Referring to FIG. 3, the powerboat 10 is shown with the trolling motor 12 deployed in the water and the outboard motor 14 tilted down in the water. Accordingly, with the motor configurations shown in FIG. 3, if the operator starts the outboard motor 14 and engages the powerboat 10 with full take-off throttle or a substantial amount of throttle, the trolling motor 12 is subjected to high forces that may damage the trolling motor 12 and/or the powerboat 10. More specifically, the high forces may bend or fracture the trolling motor shaft 16 and/or damage mounting brackets 18, which could also lead to severe structural damage of the powerboat 10. The position of trolling motor 12 as shown in FIG. 3 is therefore an undesirable position when outboard motor 14 is tilted down and engaged with full take-off throttle.

Figure 4:
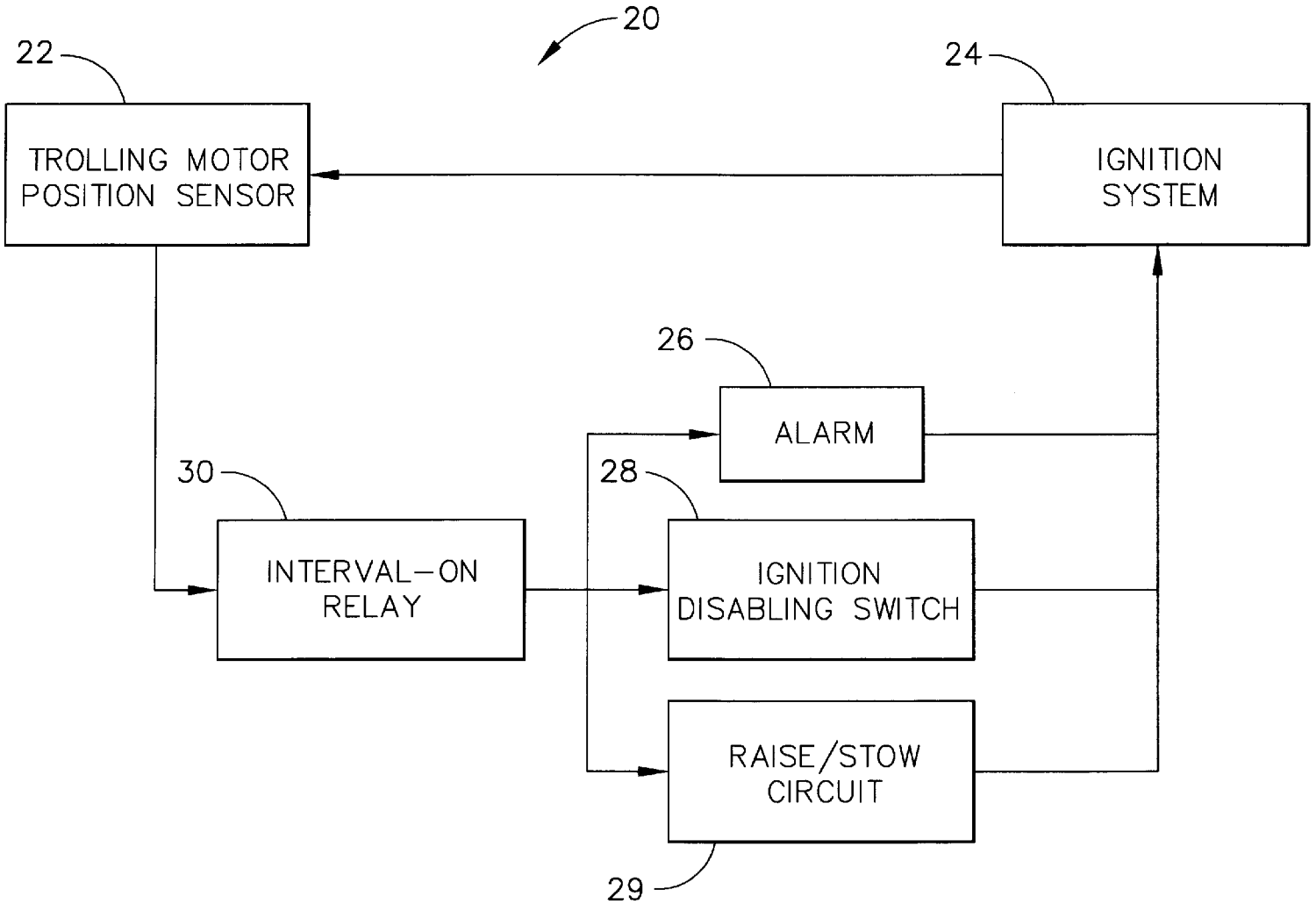
FIG. 4 is a block diagram of the position responsive system in accordance with the present invention.

Accordingly, a position responsive system that warns against and/or prevents undesirable trolling motor positions is illustrated in block diagram format and generally indicated by reference numeral 20 in FIG. 4. The position responsive system 20 generally comprises a trolling motor position sensor 22 that is in communication with the ignition system 24 of a powerboat. Generally, the trolling motor position sensor 22 senses the relative position of the trolling motor, i.e. whether the trolling motor 12 is properly stowed as shown in FIG. 1, or whether the trolling motor 12 is deployed in the water as shown in FIGS. 2 and 3.

If a user attempts to start the outboard motor 14 while the trolling motor 12 is deployed in the water, the trolling motor position sensor 22 activates an alarm 26 that warns the operator that the trolling motor 12 is deployed in the water. Additionally, an ignition disabling switch 28 is similarly activated to prevent the operator from engaging the ignition system 24 and starting the outboard motor 14 when the trolling motor 12 is deployed in the water. Furthermore, either or both the alarm 26 and the ignition disabling switch 28 may be employed in the position responsive system 20 in accordance with the present invention, depending on the specific operator requirements.

Optionally, a raise/stow circuit 29 may be activated such that the trolling motor is automatically raised and stowed prior to starting ignition system 24. Therefore, the position responsive system 20 warns against and/or prevents engaging the outboard motor 14 when the trolling motor 12 is in an undesirable position using one or a combination of the alarm, the ignition disabling switch 28, and the raise/stow circuit 29.

As further shown, the position responsive system 20 also comprises an interval-on relay 30 that that limits the amount of time that the alarm 26 or the ignition disabling switch 28 is activated. Accordingly, the position responsive system 20 may be designed to warn the operator or prevent ignition of the outboard motor 14 for a predetermined amount of time, and then allow the user to start the outboard motor 14 at their own risk. Often times, an operator may desire to slowly maneuver the powerboat 10 with the outboard motor 14 rather than the trolling motor 12 at a speed that will not result in any damage. As a result, the interval-on relay 30 allows the alarm 26 and/or the ignition disabling switch 28 to be bypassed after a predetermined amount of time for such an operating condition. Additionally, the interval-on relay 30 may be employed to prevent against wave-induced alarms or activation of the ignition disabling switch 28 with certain types of sensors used for the trolling motor position sensor 22 as described in greater detail below.

Figure 5:
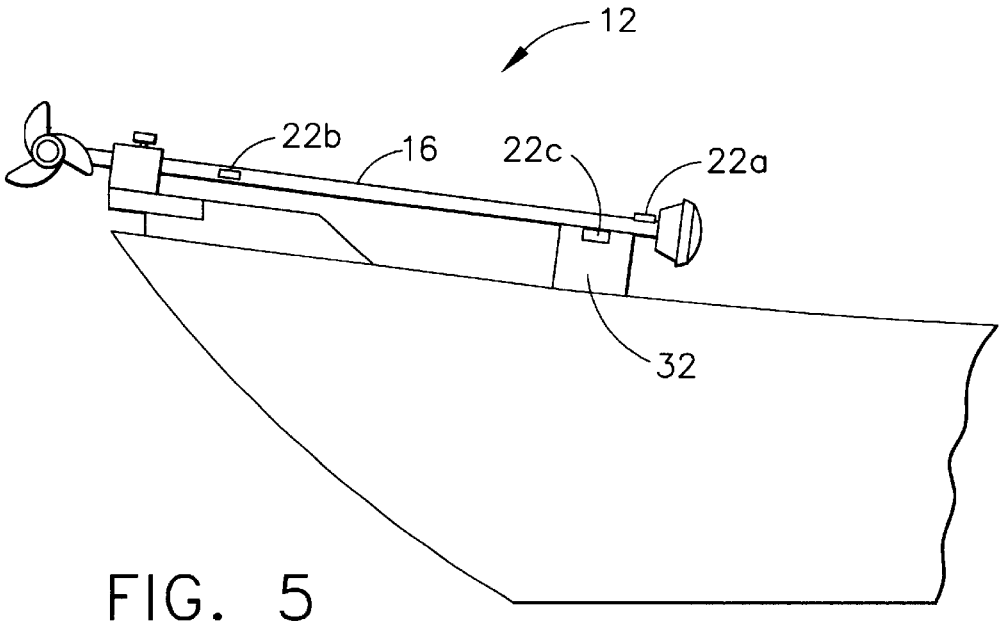
FIG. 5 is an enlarged view of the trolling motor of FIG. 1 in accordance with the present invention.
Figure 6:
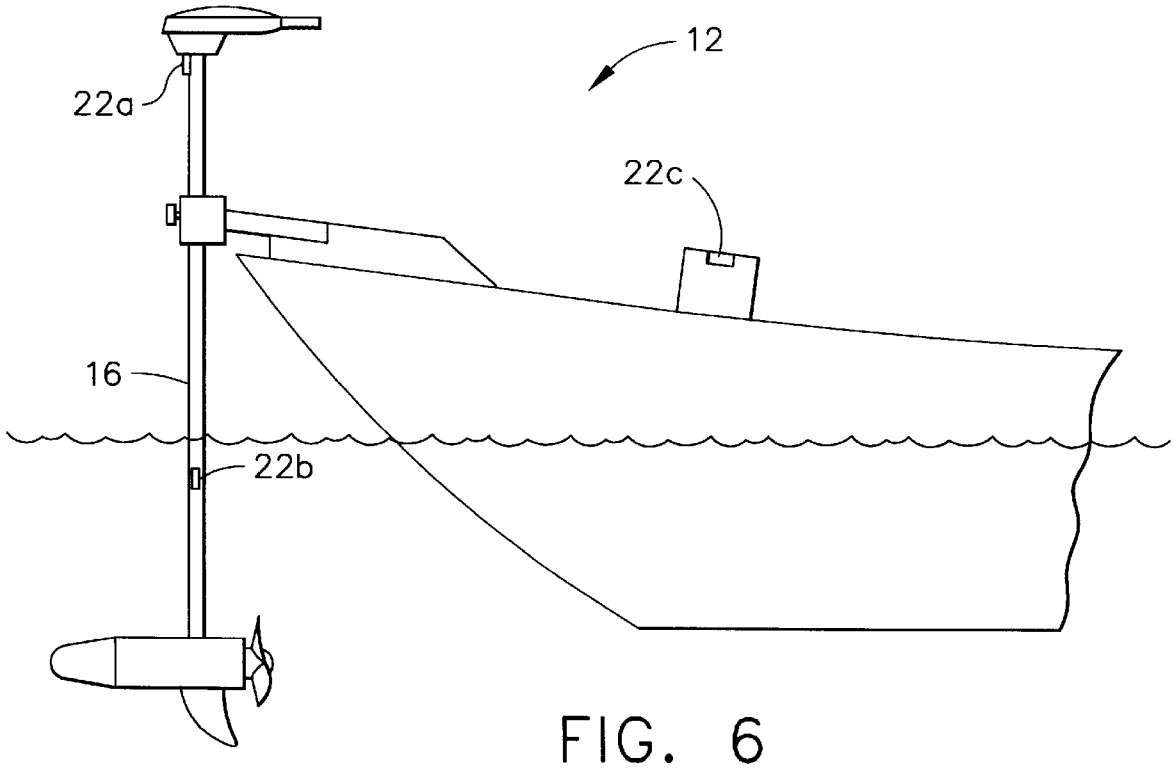
FIG. 6 is an enlarged view of the trolling motor of FIGS. 2 and 3 in accordance with the present invention.

Referring to FIGS. 5 and 6, the trolling motor position sensor 22 in one form is a mercury switch 22*a* that is mounted to the shaft 16 of trolling motor 12. The relative position of the trolling motor position sensor 22 on the shaft 16 is adjustable, as long as the contacts of the mercury switch 22*a* are closed when the trolling motor 12 is deployed in the water and are open when the trolling motor 12 is in a properly stowed position.

With the mercury switch embodiment, the interval-on relay 30 as previously described is further employed to prevent against wave-induced alarms. Since mercury within the mercury switch 22*a* randomly moves about while the powerboat 10 is traversing through the water, intermittent electrical continuity is created, thereby causing inadvertent activation of the alarm 26 and/or the ignition disabling switch 28. Interval-on relay 30 prevents against such alarms since the interval-on relay 30 is turned off after the outboard motor is engaged after the predetermined time. Accordingly, the interval-on relay 30 is automatically reset when the ignition is turned off.

If the ignition system 24 of the powerboat 10 is turned on while the trolling motor 12 remains deployed in the water, the alarm 26 and/or ignition disabling switch 28 is activated for a predetermined amount of time, for example, five (5) seconds. After the predetermined amount of time, the interval-on relay is turned off and the powerboat 10 may be operated through the water without repeated instances of wave-induced alarms and/or ignition disabling.

Accordingly, the interval-on relay 30 prevents against intermittent activation of the alarm 26 and/or the ignition disabling switch 28 while the powerboat 10 is traversing through the water at full or substantial throttle. The interval-on relay 30 also allows the powerboat to be moved slowly to another location by the outboard motor 14 while the trolling motor 12 is deployed in the water without listening to the alarm 26 and/or disabling the ignition for more than the predetermined amount of time, wherein the operator is reminded to move slowly. Preferably, the interval-on relay 30 is automatically reset when the ignition system 24 turned off.

In another form, the trolling motor position sensor 22 is a water detector 22*b* that detects the presence of water and therefore senses the deployed and stowed positions of trolling motor 12. If no water is detected, the water detector 22*b* senses the properly stowed position of the trolling motor 12 and thus the alarm 26 and/or the ignition disabling switch 28 are bypassed. Conversely, if water is detected, the water detector 22*b* senses the deployed position of trolling motor 12 and activates the alarm 26 and/or the ignition disabling switch 28. Furthermore, if a water detector 22*b* is used instead of a mercury switch 22*a*, the need for the interval-on relay 30 to prevent against wave-induced alarms may be eliminated. However, the interval-on relay 30 may still be desired to only warn the operator and thereafter allow the operator to engage the outboard motor 14 at their own risk.

In yet another form, the trolling motor position sensor 22 is a mechanical limit switch, a proximity switch, or an optical switch that senses the relative position of trolling motor 12. As shown in FIG. 5, the mechanical, proximity, or optical switch 22*c* is preferably disposed on the trolling motor 12 and on an adjacent trolling motor mount 32. When trolling motor 12 is in a properly stowed position as shown, the contacts of the mechanical, proximity, or optical switch 22*c* are open, and thus the alarm 26 and/or ignition disabling switch 28 is bypassed. Conversely, when trolling motor 12 is deployed in the water as shown in FIG. 6, the contacts of the mechanical, proximity, or optical switch 22*c* are closed, thereby causing alarm 26 and/or ignition disabling switch 28 to be activated when the ignition system 24 is engaged.

The alarm 26 of the position responsive system 20 may be audible and/or visible so as to effectively warn the operator of the powerboat 10 of an undesirable trolling motor position. In one form, the alarm 26 is a 12-volt electric buzzer. In other forms, the alarm 26 is an audible voice command or reminder, or a visible light such as an LED (light emitting diode) located on the instrument panel of the helm.

Figure 7:
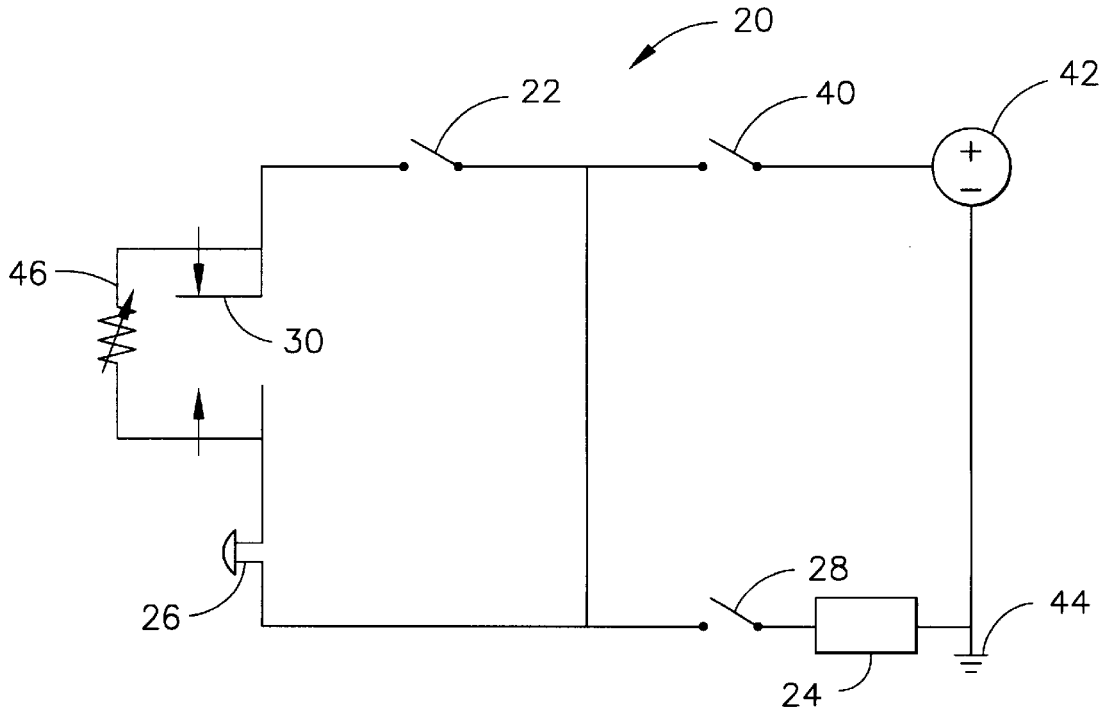
FIG. 7 is a conceptual electrical schematic of the position responsive system in accordance with the present invention.

A conceptual electrical schematic for the position responsive system 20 is illustrated in FIG. 7. As shown, the position responsive system 20 comprises the trolling motor position sensor 22, the interval-on relay 30, the alarm 26, the ignition disabling switch 28, and an ignition switch 40. The ignition switch 40 is a part of the existing ignition system 24 of powerboats, and accordingly, the position responsive system 20 may be easily retrofitted therein for operation. Furthermore, the position responsive system 20 also comprises a power source 42 and an electrical ground 44 to complete the electrical circuit as shown.

The trolling motor position sensor 22 is normally open when the trolling motor 12 is in the properly stowed position. When the ignition switch 40 is closed as the operator starts the outboard motor 14, electrical current bypasses the alarm 26 and passes through the ignition disabling switch 28, which is normally closed, to permit engaging the ignition system 24 and starting of the outboard motor 14. If, however, the trolling motor 12 is deployed in the water when the operator closes the ignition switch 40, the trolling motor position sensor 22 is closed, thereby activating the alarm 26 and/or the ignition disabling switch 28 as electrical current flows from the ignition switch 40 through the trolling motor position sensor 22 and to the alarm 26 and the ignition disabling switch 28. Accordingly, the alarm 26 and/or the ignition disabling switch 28 warn the operator that the trolling motor 12 is improperly positioned and outboard motor 14 should not be engaged with full takeoff throttle.

As shown, the interval-on relay 30 is preferably located between the trolling motor position sensor 22 and the alarm 26. Accordingly, the interval-on relay 30 is closed when the power source 42 is applied and is subsequently open after the predetermined amount of time as previously described. Therefore, if the trolling motor 12 remains deployed in the water when the ignition switch 40 is closed, the trolling motor position sensor 22 is closed, thereby permitting current to flow through the interval-on relay 30 to the alarm 26 and/or the ignition disabling switch 28. After the predetermined amount of time, the interval-on relay 30 is open and the alarm 26 and/or the ignition disabling switch 28 are then bypassed.

The amount of time that interval-on relay 30 remains closed is preferably set with a potentiometer 46 as shown. The specified amount of time in one form of the present invention is approximately five (5) seconds. After the predetermined amount of time, the interval-on relay 30 opens and is further reset in the closed position when the ignition switch 40 is opened.

In another form of the present invention, the output of the alarm 26 activates a raise/stow circuit (not shown) to automatically raise and properly stow the trolling motor 12 when the deployed position is detected. The circuit that automatically raises the trolling motor 12 is a commercially available feature on high-end trolling motors. Therefore, the position responsive system 20 may further be easily retrofitted with the electronic circuitry of existing trolling motor equipment.

Figure 8:
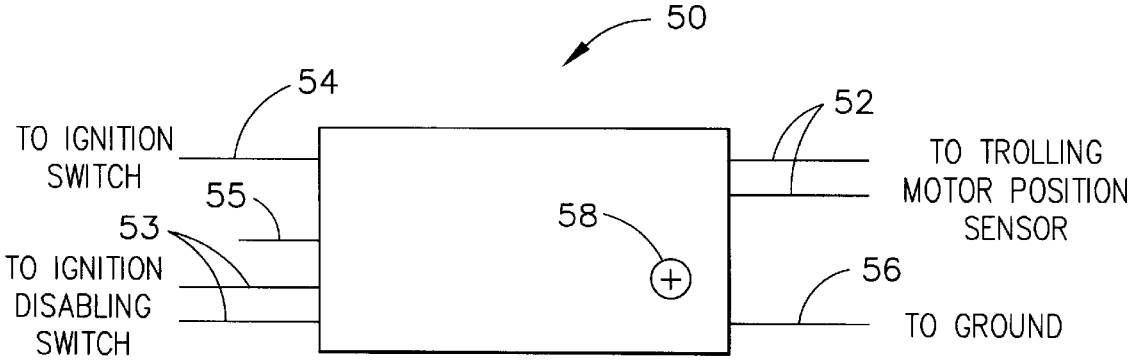
FIG. 8 is a top view of a junction box for retrofitting the position responsive system to an existing ignition system of a powerboat in accordance with the present invention.

Referring now to FIG. 8, a junction box 50 is shown that houses components of the position responsive system 20 and is easily retrofittable with existing ignition systems of powerboats. In one form, the junction box 50 is approximately 3"×4">2" in size. The junction box 50 comprises two wires 52 in communication with the trolling motor position sensor 22, two wires 53 in communication with the ignition disabling switch, a fused wire 54 in communication with the ignition switch 40, an optional wire 55 in communication with a circuit to automatically raise and properly stow the trolling motor, and a wire 56 in communication with the electrical ground 44. The junction box 50 further comprises an adjustment screw 58 that is used to adjust the potentiometer 46 that sets the amount of time of interval-on relay 30 and hence the amount of time that the alarm 26 and/or the ignition disabling switch 28 are activated.

Figure 9:
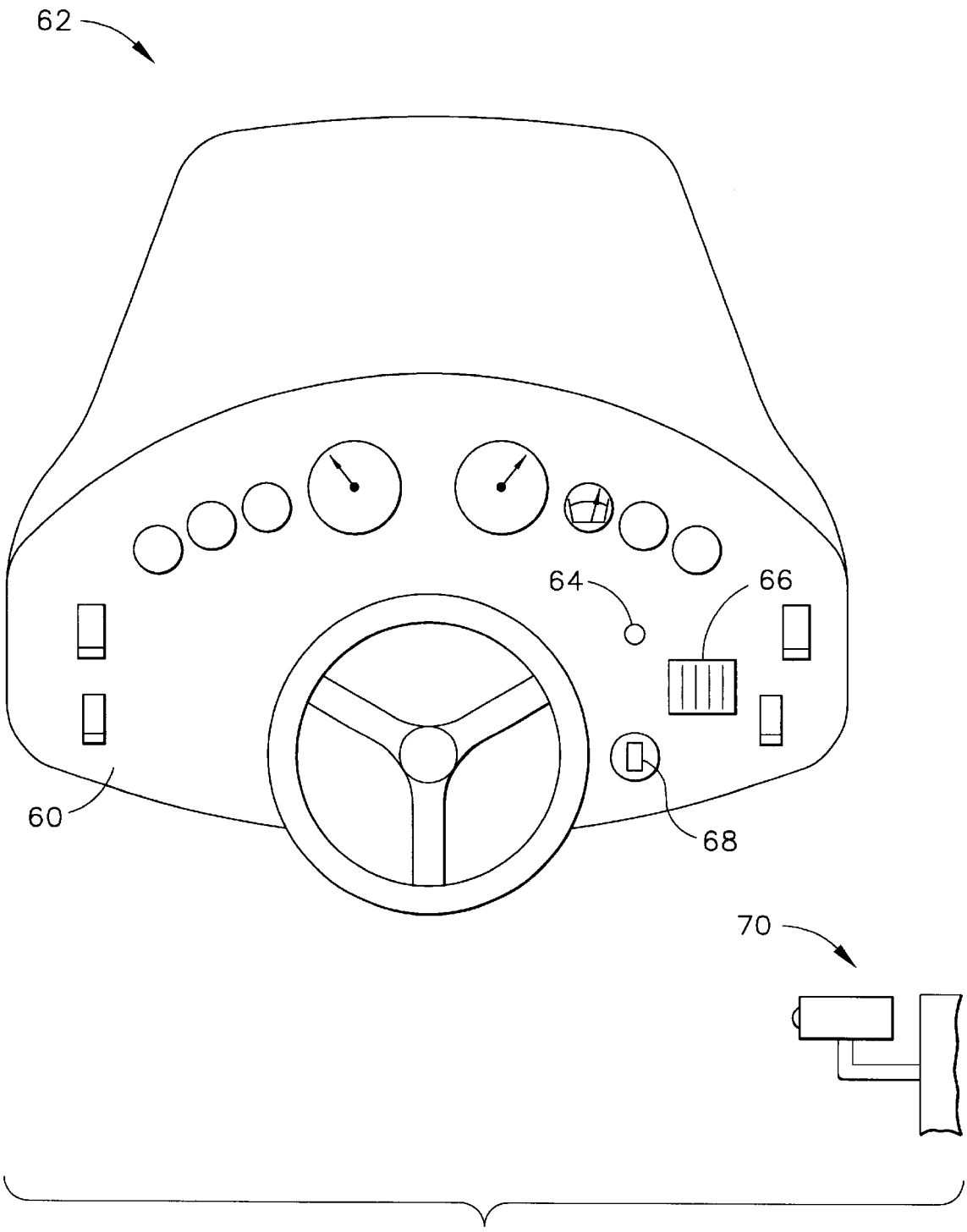
FIG. 9 is a front view of a helm of a powerboat illustrating related instrumentation in accordance with the present invention.

The locations of various output devices of the present invention are illustrated in FIG. 9 on an instrument panel 60 of a helm 62. The output devices in one form comprise an LED alarm 64 and an audible alarm 66. Other devices that are shown for a supplemental understanding of the present invention comprise an ignition switch 68 and a throttle 70. The output devices are shown in only few of many positions and configurations that may be possible depending upon the design characteristics of the helm 62 and the instrument panel 60.

Although the components of the present invention are in communiation via conventional hard-wiring as described herein, other methods commonly known in the art such as infrared (IR) signal transmission and reception, or radio frequency (RF) signal transmission and reception, among others, may also be employed. In addition, signals may be superimposed over existing powerboat hard wiring to minimize the need for additional hard wire connections.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A trolling motor position responsive system comprising:

an ignition system;

a trolling motor position sensor in communication with the ignition system; and an alarm in communication with the trolling motor position sensor, wherein when an operator attempts to engage the ignition system when the trolling motor is deployed, the alarm is activated by the trolling motor position sensor to warn the operator.

2. The trolling motor position responsive system of claim 1, wherein the trolling motor position sensor is a mercury switch.

3. The trolling motor position responsive system of claim 2 further comprising:

an interval-on relay in communication with the trolling motor position sensor, wherein the interval-on relay prevents against wave-induced alarms.

4. The trolling motor position responsive system of claim 1 further comprising:

an interval-on relay in communication with to the trolling motor position sensor, wherein the interval-on relay limits an amount of time that the alarm is activated.

5. The trolling motor position responsive system of claim 1, wherein the trolling motor position sensor is a water detector.

6. The trolling motor position responsive system of claim 1, wherein the trolling motor position sensor is selected from the group consisting of a mechanical switch, a proximity switch, or an optical switch.

7. The trolling motor position responsive system of claim 1, wherein the alarm is audible.

8. The trolling motor position responsive system of claim 1, wherein the alarm is visible.

9. The trolling motor position responsive system of claim 1 further comprising:

a raise/stow circuit in communication with the trolling motor position sensor, wherein the raise/stow circuit causes the trolling motor to automatically raise to a properly stowed position when the trolling motor position sensor activates the alarm.

10. The trolling motor position responsive system of claim 1, wherein the communications are via hard-wiring.

11. The trolling motor position responsive system of claim 1, wherein the communications are via infrared signals.

12. The trolling motor position responsive system of claim 1, wherein the communications are via radio frequency signals.

13. The trolling motor position responsive system of claim 1, wherein the communications are superimposed on existing powerboat wiring.

14. A trolling motor position responsive system comprising:

an ignition system;

a trolling motor position sensor in communication with the ignition system; and an ignition disabling switch in communication with the trolling motor position sensor, wherein when an operator attempts to engage the ignition system when the trolling motor is deployed, the ignition disabling switch is activated by the trolling motor position sensor to prevent the operator from engaging the ignition system.

15. The trolling motor position responsive system of claim 14, wherein the trolling motor position sensor is a mercury switch.

16. The trolling motor position responsive system of claim 15 further comprising:

an interval-on relay in communication with the trolling motor position sensor, wherein the interval-on relay prevents against wave-induced activation of the ignition disabling switch.

17. The trolling motor position responsive system of claim 14 further comprising:

an interval-on relay in communication with the trolling motor position sensor, wherein the interval-on relay limits an amount of time that the ignition disabling switch is activated.

18. The trolling motor position responsive system of claim 14, wherein the trolling motor position sensor is a water detector.

19. The trolling motor position responsive system of claim 14, wherein the trolling motor position sensor is selected from the group consisting of a mechanical switch, a proximity switch, or an optical switch.

20. The trolling motor position responsive system of claim 14 further comprising:

a raise/stow circuit in communication with the trolling motor position sensor, wherein the raise/stow circuit causes the trolling motor to automatically raise to a properly stowed position when the trolling motor position sensor activates the ignition disabling switch.

21. The trolling motor position responsive system of claim 14, wherein the communications are via hard-wires.

22. The trolling motor position responsive system of claim 14, wherein the communications are via infrared signals.

23. The trolling motor position responsive system of claim 14, wherein the communications are via radio frequency signals.

24. The trolling motor position responsive system of claim 14, wherein the communications are superimposed on existing powerboat wiring.

25. A trolling motor position responsive system comprising:

an ignition system;

a trolling motor position sensor in communication with the ignition system; and a raise/stow circuit in communication with the trolling motor position sensor, wherein when an operator attempts to engage the ignition system when the trolling motor is deployed, the raise/stow circuit is activated by the trolling motor position sensor to automatically raise the trolling motor to a properly stowed position.

26. The trolling motor position responsive system of claim 25, wherein the trolling motor position sensor is a mercury switch.

27. The trolling motor position responsive system of claim 26 further comprising:

an interval-on relay in communication with the trolling motor position sensor, wherein the interval-on relay prevents against wave-induced activation of the raise/stow circuit.

28. The trolling motor position responsive system of claim 25, wherein the trolling motor position sensor is a water detector.

29. The trolling motor position responsive system of claim 25, wherein the trolling motor position sensor is selected from the group consisting of a mechanical switch, a proximity switch, or an optical switch.

30. The trolling motor position responsive system of claim 25, wherein the communications are via hard-wires.

31. The trolling motor position responsive system of claim 25, wherein the communications are via infrared signals.

32. The trolling motor position responsive system of claim 25, wherein the communications are via radio frequency signals.

33. The trolling motor position responsive system of claim 25, wherein the communications are superimposed on existing powerboat wiring.

34. A trolling motor position responsive system comprising:

an ignition system;

a trolling motor position sensor in communication with the ignition system;

an alarm in communication with the trolling motor position sensor; and an ignition disabling switch in communication with the trolling motor position sensor, wherein when an operator attempts to engage the ignition system when the trolling motor is deployed, the alarm is activated by the trolling motor position sensor to warn the operator and the ignition disabling switch is activated by the trolling motor position sensor to prevent the operator from engaging the ignition system.

35. The trolling motor position responsive system of claim 34, wherein the trolling motor position sensor is a mercury switch.

36. The trolling motor position responsive system of claim 35 further comprising:

an interval-on relay in communication with the trolling motor position sensor, wherein the interval-on relay prevents against wave-induced alarms.

37. The trolling motor position responsive system of claim 34 further comprising:

an interval-on relay in communication with the trolling motor position sensor, wherein the interval-on relay limits an amount of time that the alarm and the ignition disabling switch are activated.

38. The trolling motor position responsive system of claim 34, wherein the trolling motor position sensor is a water detector.

39. The trolling motor position responsive system of claim 34, wherein the trolling motor position sensor is selected from the group consisting of a mechanical switch, a proximity switch, or an optical switch.

40. The trolling motor position responsive system of claim 34, wherein the alarm is audible.

41. The trolling motor position responsive system of claim 34, wherein the alarm is visible.

42. The trolling motor position responsive system of claim 34 further comprising:

a raise/stow circuit in communication with the trolling motor position sensor, wherein the raise/stow circuit causes the trolling motor to automatically raise to a properly stowed position when the trolling motor position sensor activates the alarm and the ignition disabling switch.

43. The trolling motor position responsive system of claim 34, wherein the communications are via hard-wires.

44. The trolling motor position responsive system of claim 34, wherein the communications are via infrared signals.

45. The trolling motor position responsive system of claim 34, wherein the communications are via radio frequency signals.

46. The trolling motor position responsive system of claim 34, wherein the communications are superimposed on existing powerboat wiring.

47. A trolling motor position responsive device comprising:

a trolling motor position sensor; and an alarm in communication with the trolling motor position sensor, wherein when an operator attempts to engage an outboard motor when the trolling motor is deployed, the alarm is activated by the trolling motor position sensor to warn the operator.

48. The device of claim 47 further comprising:

a junction box that is adapted for communication with an ignition system of the powerboat, wherein the alarm is disposed within the junction box.

49. The device of claim 48 further comprising:

an interval-on relay in communication with the trolling motor position sensor, wherein the interval-on relay limits an amount of time that the alarm is activated.

50. The device of claim 49 further comprising:

a potentiometer in communication with the interval-on relay, wherein the potentiometer adjusts the amount of time that the alarm is activated.

51. The device of claim 50 further comprising:

an adjustment screw mounted to the junction box and in communication with the potentiometer to adjust the amount of time that the alarm is activated.

52. A trolling motor position responsive device comprising:

a trolling motor position sensor; and an ignition disabling switch in communication with the trolling motor position sensor, wherein when an operator attempts to engage an outboard motor when the trolling motor is deployed, the ignition disabling switch is activated by the trolling motor position sensor to prevent the operator from engaging the outboard motor.

53. The device of claim 52 further comprising:

a junction box that is adapted for communication with an ignition system of the powerboat, wherein the ignition disabling switch is disposed within the junction box.

54. The device of claim 53 further comprising:

an interval-on relay in communication with the trolling motor position sensor, wherein the interval-on relay limits an amount of time that the ignition disabling switch is activated.

55. The device of claim 54 further comprising:

a potentiometer in communication with the interval-on relay, wherein the potentiometer adjusts the amount of time that the alarm is activated.

56. The device of claim 55 further comprising:

an adjustment screw mounted to the junction box and in communication with the potentiometer to adjust the amount of time that the alarm is activated.

57. A trolling motor position responsive device comprising:

a trolling motor position sensor; and a raise/stow circuit in communication with the trolling motor position sensor, wherein when an operator attempts to engage an outboard motor when the trolling motor is deployed, the raise/stow circuit is activated by the trolling motor position sensor to automatically raise the trolling motor to a properly stowed position.

58. A trolling motor position responsive device comprising:

a trolling motor position sensor;

an alarm in communication with the trolling motor position sensor; and an ignition disabling switch in communication with the trolling motor position sensor, wherein when an operator attempts to engage an outboard motor when the trolling motor is deployed, the alarm is activated by the trolling motor position sensor to warn the operator and the ignition disabling switch is activated by the trolling motor position sensor to prevent the operator from engaging the outboard motor.

59. The device of claim 58 further comprising:

a junction box that is adapted for communication with an ignition system of the powerboat, wherein the alarm and the ignition disabling switch are disposed within the junction box.

60. The device of claim 59 further comprising:

an interval-on relay in communication with the trolling motor position sensor, wherein the interval-on relay limits an amount of time that the alarm and the ignition disabling switch are activated.

61. The device of claim 60 further comprising:

a potentiometer in communication with the interval-on relay, wherein potentiometer adjusts the amount of time that the alarm and the ignition disabling switch are activated.

62. The device of claim 61 further comprising:

an adjustment screw mounted to the junction box and in communication with the potentiometer to adjust the amount of time that the alarm and the ignition disabling switch are activated.

* * * * *